US005651206A

United States Patent [19]

Matarazzo

[11] Patent Number: 5,651,206

[45] Date of Patent: Jul. 29, 1997

[54] SAFETY DEVICE

[76] Inventor: Frederick Matarazzo, 46680 Paragon Ter., Sterling, Va. 20164

[21] Appl. No.: 637,381

[22] Filed: Apr. 24, 1996

[51] Int. Cl.[6] ..... F41A 17/06

[52] U.S. Cl. ..... 42/70.08; 42/70.06; 42/66

[58] Field of Search ..... 42/70.11, 70.06, 42/70.08, 129 A, 66

[56] References Cited

U.S. PATENT DOCUMENTS

| | | | |
|---|---|---|---|
| 4,105,885 | 8/1978 | Ovenstein | 42/84 |
| 4,110,928 | 9/1978 | Smith | 42/66 |
| 4,135,320 | 1/1979 | Smith | 42/66 |
| 4,154,014 | 5/1979 | Smith | 42/70.08 |
| 4,317,969 | 3/1982 | Riegler et al. | 200/51.09 |
| 4,682,435 | 7/1987 | Heltzel | 42/70.11 |
| 4,833,811 | 5/1989 | Wilkinson | 42/70.08 |
| 5,016,376 | 5/1991 | Pugh | 42/70.11 |
| 5,062,232 | 11/1991 | Eppler | 42/70.11 |
| 5,148,053 | 9/1992 | Dubois, III | 192/129 A |

FOREIGN PATENT DOCUMENTS

| | | | |
|---|---|---|---|
| 4303333 | 6/1994 | Germany | 42/70.11 |

*Primary Examiner*—Stephen M. Johnson

[57] ABSTRACT

A safety device for controlling the operation of equipment and most specifically blocking the firing mechanism of a weapon including a plunger having a piston including a magnet section and an actuating rod secured to the piston, the actuating rod being so situated as to block the firing mechanism of the weapon, the plunger being mounted in a sleeve, the operator having a ferromagnetic disk secured to the hand, which causes the magnet section of the piston to withdraw the piston and the actuating rod, the piston and the actuating rod returning to the locked position in the absence of the ferromagnetic disk due to the magnetic draw on the magnet section of the piston either from the weapon itself or in the absence of such magnetic draw from a ferromagnetic disk mounted in the sleeve.

6 Claims, 6 Drawing Sheets

SAFETY DEVICE

BACKGROUND OF THE INVENTION

Safety devices on weapons such as pistols and rifles are well known. Unfortunately, such safety devices, specifically those which are actuated by the user of the weapon, have often proven themselves to be more unsafe than safe. The person handling the weapon sometimes believes the safety device to have disabled the weapon only to find later that their recollection is erroneous resulting in serious injury. Another serious defect of such safety devices is the delay caused to a person having possession of a weapon, such as a police officer, who is under attack, and who is delayed in firing the weapon due to the safety being in the on position and the weapon disabled. There is also the fear on the part of one armed with a weapon, again most particularly a police officer, that it will be seized by intent on harming them and their own very weapon used against them.

This invention provides a safety device that is actuated by a ferromagnetic disk on the hand of the operator and is automatic when the operator takes the weapon in hand to be used. When not in the operator's hand or in a hand lacking the ferromagnetic disk, the weapon cannot fire and when seized by someone else, the safety device will not release since the adverse party grabbing the weapon will not have the ferromagnetic disk on their hand and will also not know exactly where to place the ferromagnetic disk, if available.

Other equipment besides weapons where unauthorized and improper operation can result in injury can also use such a safety device.

Previously, the use of magnetism to operate a safety device for a weapon has been taught but in a manner distinctive of that claimed by this invention. Two patents by Joseph E. Smith, U.S. Pat. No. 4,110,928 and U.S. Pat. No. 4,154,014 use magnetism to deflect a member which otherwise blocks operation of the weapon.

SUMMARY OF THE INVENTION

In accordance with the present invention, an actuating rod prevents movement of an essential part of the firing mechanism of a weapon which must move in order for the weapon to fire. A sleeve is mounted in the weapon with the outside end of the sleeve at the surface of the weapon. The sleeve has a large chamber located in it and extending from the outside end of the sleeve for a major portion of the length of the sleeve with a small opening extending from the large chamber to the inside end of the sleeve. A piston is mounted to slide within the large chamber. The piston is constructed in two sections, one being a magnet section located toward the outside end of the sleeve which is rigidly secured to a base section of nonferromagnetic material which is rigidly secured to an actuating rod mounted to slide in the small opening. A retainer cap covers the large chamber at the outside end of the sleeve. A ferromagnetic disk is used by the operator of the weapon to draw the magnet section toward the ferromagnetic disc and thereby withdrawing the actuating rod away from that movable part of the of the firing mechanism of the weapon prevented from movement by the presence of the actuating rod. The ferromagnetic disk is preferably mounted on a glove worn on the firing hand of the operator and placed on the glove so as to align itself with the outside end of the sleeve. Upon firing of the weapon and return of the weapon to the its holding position, presumably a holster, the ferromagnetic disk is no longer near the magnet section of the piston and the ferromagnetic material in the weapon itself usually causes the piston to move toward the inside end of the cylinder and thus return the actuating rod to a position where it again blocks the movement of some movable part of the firing mechanism of the weapon. Where the location of the sleeve or the specific makeup of the weapon fails to provide sufficient ferromagnetic material to cause the piston to move toward the inside end of the sleeve, a ferromagnetic washer is mounted at the inside end of large chamber so as to draw the piston back to the locked position. A cushioning washer is also placed at the end of the large chamber toward the inside end of the sleeve to cushion the seating of the piston in its most inside position. If a ferromagnetic washer is used, the ferromagnetic washer is placed adjacent the cushioning washer toward the inside end of the sleeve.

It is an object of the present invention to provide a device which fully disables the weapon and prevents firing of the weapon except by the operator having the proper ferromagnetic disk properly located on the firing hand of that operator.

It is a further object of the present invention to provide a safety device for a weapon that is durable and does not fail due to rough use of the weapon.

It is a further object of the present invention to provide a safety device that can be used with a variety of equipment where unauthorized operaton can result in danger.

It is a further object of the present invention to provide a safety device that can be inexpensively constructed and installed.

The subject matter of the present invention is particularly pointed out and distinctly claimed in the concluding portion of the specification. However, both the organization and method of operation, together with further advantages and objects thereof, may be best understood by reference to the following description taken in connection with the accompanying drawings wherein like reference characters refer to like elements.

DETAILED DESCRIPTION OF THE INVENTION

Figure 1:
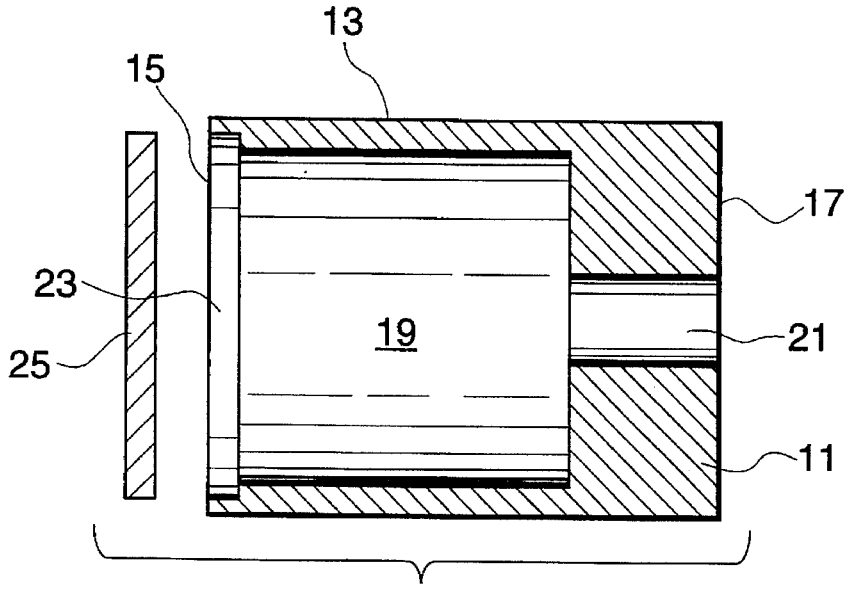
FIG. 1 is side cross-sectional view of the sleeve used in the safety device showing the retaining cap removed from the sleeve.
Figure 2:
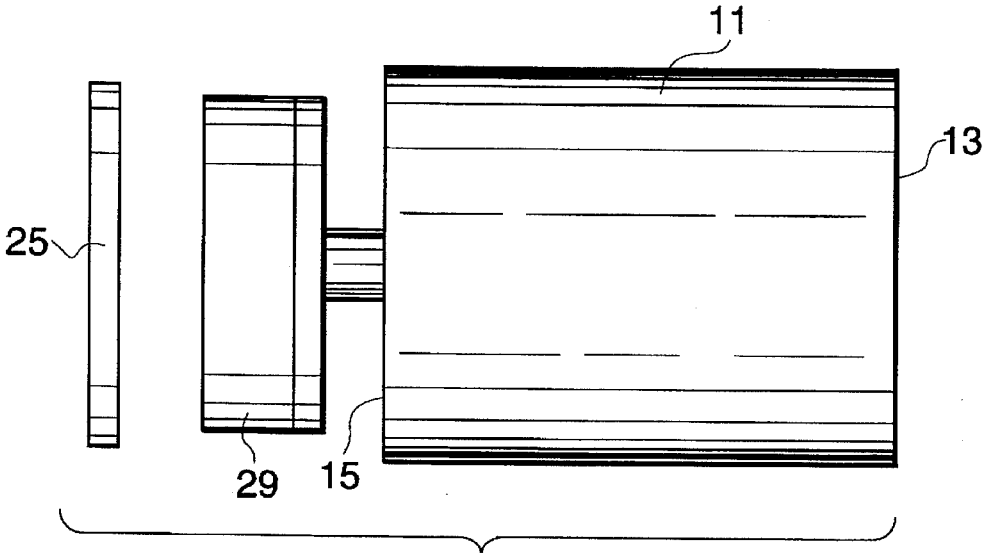
FIG. 2 is a side elevation of the safety device showing the sleeve with the plunger partially removed and the retaining cap removed from the sleeve.

Referring now to the drawings and more particularly to FIG. 1, a sleeve 11 is shown. The sleeve 11 includes a cylindrical member 13 having an outside end 15 and an inside end 17. As best seen in FIGS. 6 through 9, the outside end 15 of the cylindrical member 13 and sleeve 11 is located generally at the surface of the weapon (see FIGS. 6 through 9) in some region of the weapon where the operator's hand will grip the weapon. The inside end 17 is the opposite end and is located in the weapon at a point where a movable part of the firing mechanism is located.

Referring back to FIG. 1, a large cylindrical chamber 19 is formed in the cylindrical member 13 and extends from the outside end 15 a major portion of the length of the cylindrical member 13. The large cylindrical chamber 19 is cylindrical and is concentrically located within the cylindrical member 13 along the longitudinal axis of the cylindrical member 13. A small cylindrical opening 21 extends from the large cylindrical chamber 19 to the inside end 17 of the cylindrical member 13. The small cylindrical opening 21 is also cylindrical and is located concentrically along the longitudinal axis of the cylindrical member 13. At the outside end 15, a retainer chamber 23 is formed which is very short, is also cylindrical and has a diameter slightly larger than the diameter of the large cylindrical chamber 19. The retainer chamber 23 is also located concentrically about the longitudinal axis of the cylindrical member 13. The retainer chamber 23 serves as a repository for the retainer cap 25 which is press secured in the retainer chamber 23 to seal the sleeve 11. The retainer cap 25 may be secured by press fitting, by a thread of by a lock design but regardless of the means of securing the retainer cap 25, the retainer cap should be removable. The retainer cap 25 may become part of the surface of the weapon once the sleeve 11 is installed into the weapon and becoming part of the surface of the weapon is likely in a retrofit situation but where possible, the safety device will be under a removable surface of the weapon such as the handle grips.

Figure 3:
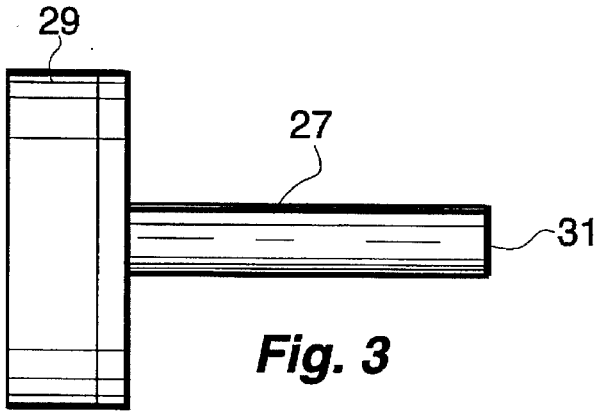
FIG. 3 is a side elevation of the plunger used in the sleeve.

Referring now to FIG. 3, a plunger 27 is shown. The plunger 27 includes a piston 29 and an actuating rod 31 extending from the piston 29. The piston 29 is cylindrical and the actuating rod 31 is rigidly secured to it and is concentrically mounted on the piston 29. The piston 29 is sized to fit inside the large cylindrical chamber 19 in a sliding relationship and therefore the piston 29 is just slightly smaller in diameter than the large cylindrical chamber 19. The actuating rod 31 is located in the small cylindrical opening 21 as seen is FIGS. 4 and 5. The actuating rod 31 slides within the small cylindrical opening 21 and is sized so as to be just slightly smaller than the small cylindrical opening 21 to achieve a fit that does not retard movement of the plunger 27 but is firm. A coating of a very low friction material on the large cylindrical chamber 19 and the small cylindrical opening 21 will assure the least amount of resistance to the movement of the plunger 27.

Figure 4:
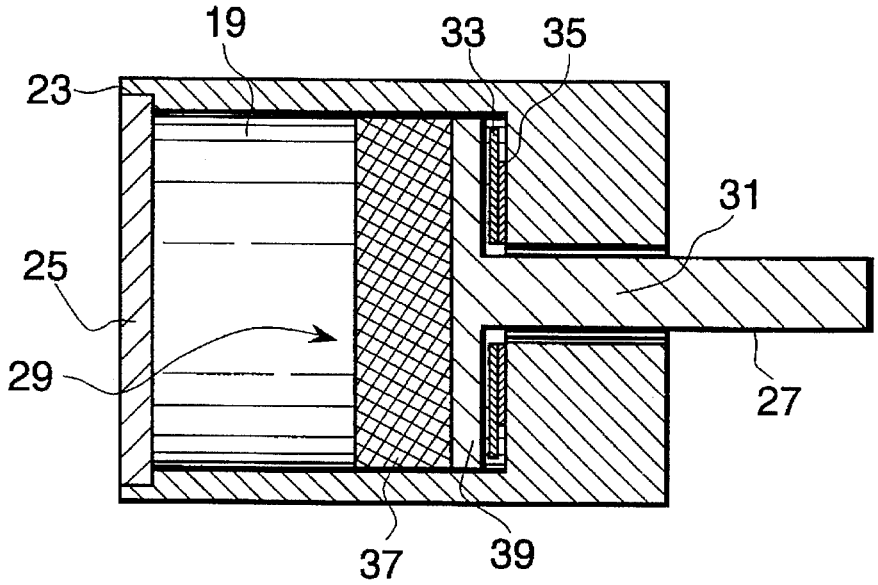
FIG. 4 is a side cross-sectional view of the safety device showing the sleeve with the plunger mounted in the sleeve and with the retainer cap in place and with the cushion washer and ferromagnetic washer in place inside the piston of the plunger.
Figure 5:
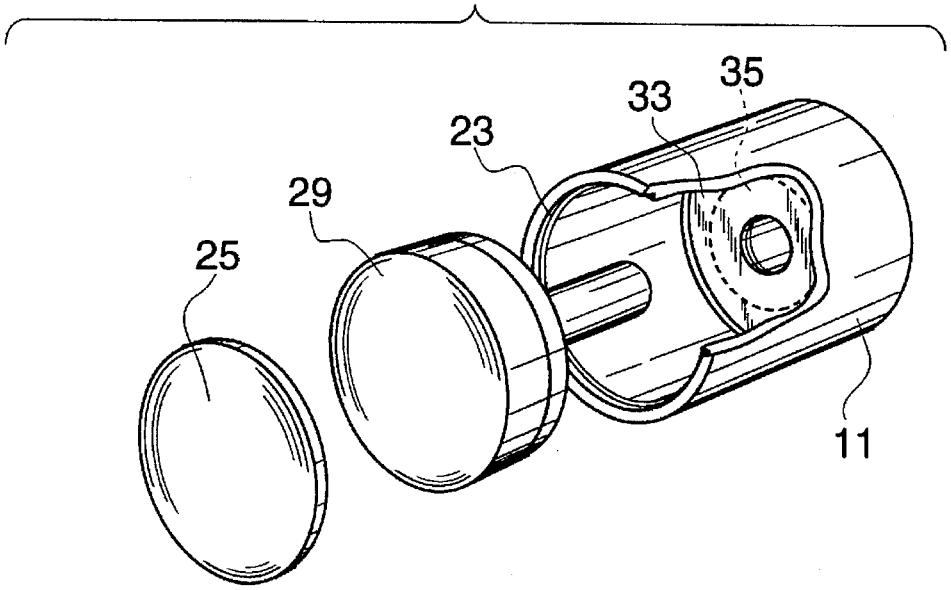
FIG. 5 is an exploded view showing the retainer cap and the plunger and the sleeve and the cushion washer and the ferromagnetic washer.

As seen in FIGS. 4 and 5, a cushioning washer is mounted around the actuating rod 31 at the inside end 17 of the large cylindrical chamber 19. Where needed to strengthen the return pull of the piston 29 to a locked position, a ferromagnetic washer 35 is located adjacent the cushioning washer 33. The cushioning washer 33 is toward the outside end 15 of the cylindrical member 13 from the ferromagnetic washer 35 but both the cushioning washer 33, as best seen in FIGS. 4 and 5, are toward the inside end 17 beyond the piston 29 and about the actuating rod 31.

The sleeve 11 needs to be formed from a nonferromagnetic material and one readily available material meeting that requirement is brass. The retainer cap 25 also needs to be nonferromagnetic and plastic is a suitable of material for that purpose. The piston 29 is made from two materials and, as seen in FIGS. 4 and 5, is formed in two sections, which are layered, namely a magnet section 37 and a nonferromagnetic section 39. The magnet section 37 is located toward the outside end 15 and the nonferromagnetic section is located toward the inside end 17. The two sections 37,39 must be securely affixed to one another. One possible means to achieve this affixation is by use of a strong commercial adhesive such as a commercial epoxy but the two sections 37,39 may also be mechanically connected by use of a machine bolt through the magnet section 37 into the nonferromagnetic section 39 and into the actuating rod 31. Still another possibility is to extend the actuating rod 31 or an extension of the actuating rod 31 possibly of reduced diameter through the magnet section 37 and then flare the end of the extension of the actuating rod 31 to secure the two sections 37,39 together and to the actuating rod 31.

The designation herein of a part as being "ferromagnetic" means that it is magnetically oriented to a magnet but does not mean that such a partis a magnet. The magnet section 37, however, is a permanent magnet. The term "nonferromagnet" means a part which does not attract to a magnet.

As best seen in FIGS. 6 through 9, the operator wears a glove 41 with a ferromagnetic disk 43 affixed to the glove 41. The affixing of the ferromagnetic disk 43 to the glove 41 is preferably achieved by use of a strong adhesive. The location of the ferromagnetic disk 43 depends upon where the safety device is located on the weapon.

Figure 6:
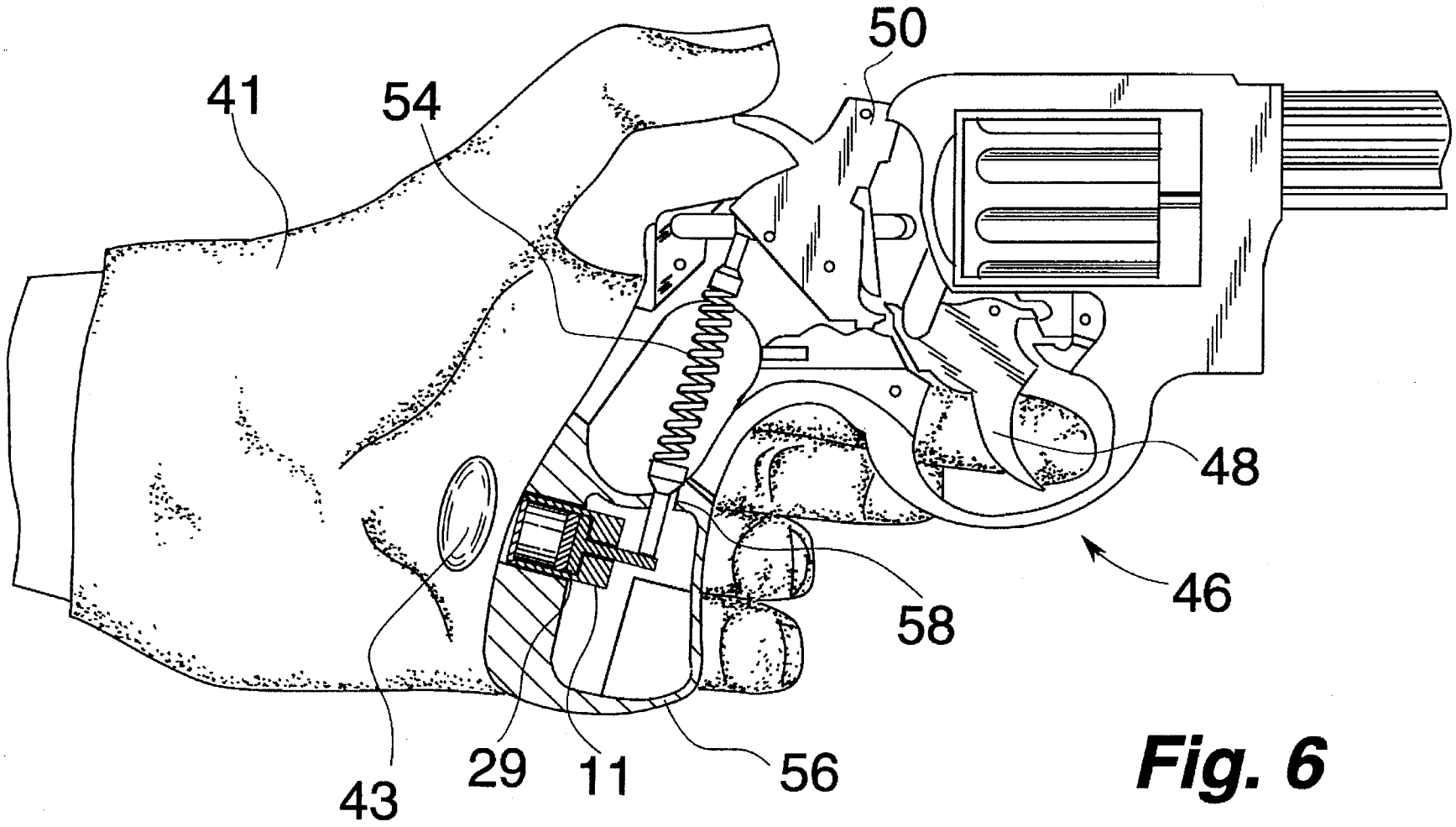
FIG. 6 is a side plan view partially in cross section of an existing revolver showing the safety device in place and the hand of an operator holding the revolver with the metal disk in place on a glove on the hand of the operator.

In FIG. 6, one version of a revolver 46 is shown having a trigger 48 and a hammer 50 operated by a compression spring 52 with a shaft 54 within the compression spring 52 which biases the shaft 54 against the hammer 50. The compression spring 52 and shaft 54, as shown, are within the handle 56 of the revolver 46. The shaft 54 is slidable in a track 58. The safety device is mounted in the rear and lower area of the handle 56 of the revolver 46. Withdrawal of the hammer 50, either by pulling back the hammer 50 with the thumb or pulling the trigger 48 which forces the hammer 50 back, as is well-known to be done with revolvers, forces the shaft 54 down into the handle 56. However, with the safety device mounted in the weapon, the shaft 54 cannot move downward and the revolver 46 becomes totally inoperative unless and until the actuating rod 31 of the safety device is withdrawn permitting the shaft 54 to move downward as it would move absent the presence of the safety device in the weapon. The operator of the weapon, wearing the glove 41, or the part of a glove 41 with the ferromagnetic disk 43 mounted thereon, thus can readily permit operation of the revolver 46 or other weapon but someone else seizing the weapon cannot cause the revolver to function.

Figure 7:
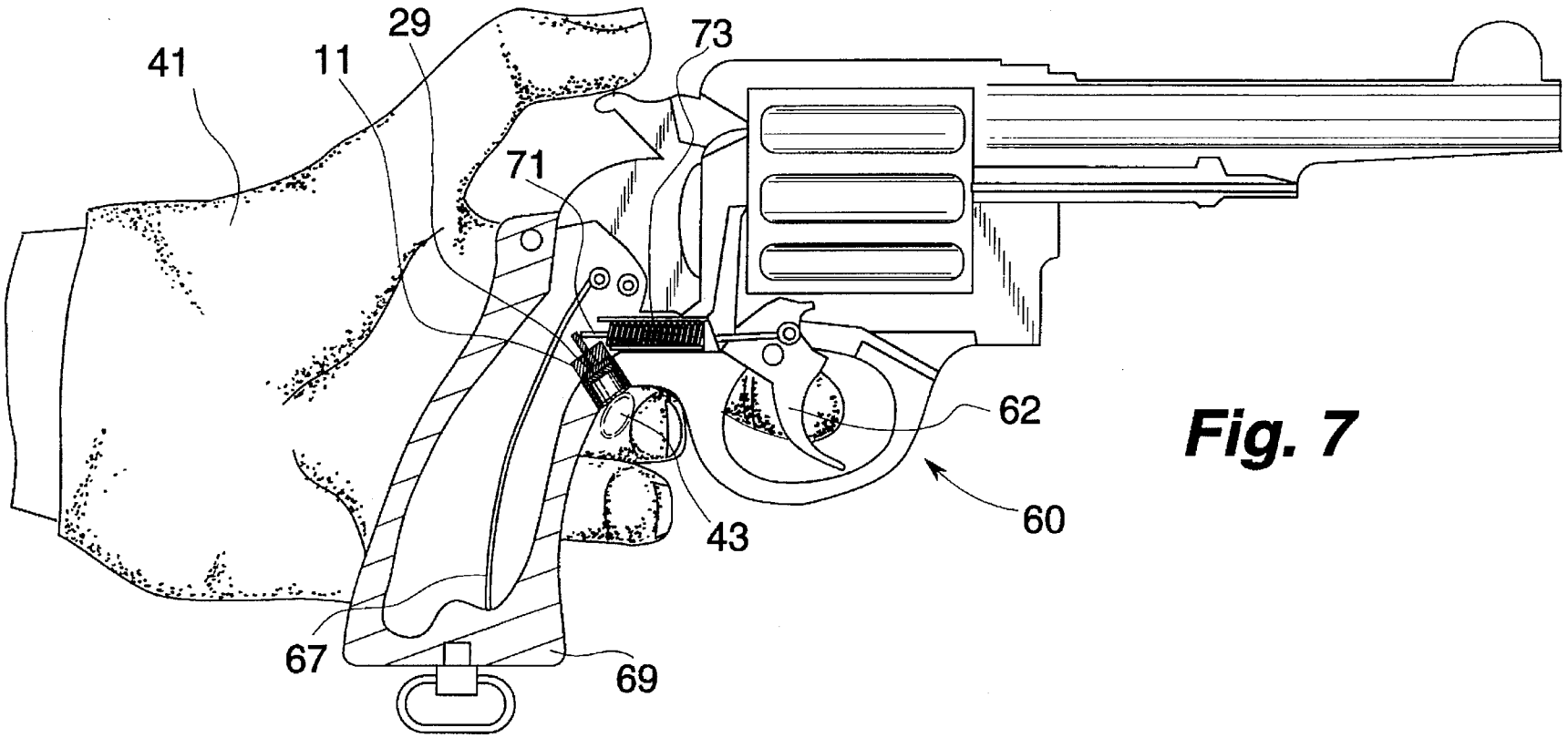
FIG. 7 is a side plan view of another version of an existing revolver partially in cross-section showing the safety device located at a different location on the revolver and showing the glove with the ferromagnetic disk on the glove and the glove on the hand of the operator.

FIG. 7 shows still another version of an existing revolver 60 having many similar parts to the revolver 46 shown in FIG. 6 but having a different theory of operation. This version, as shown in FIG. 7, includes a trigger 62 and a hammer 64 and has a leaf spring 67 in the handle 69 and a rebound slide pin 71 and a rebound slide spring 73 connected to the trigger 62. The safety device is mounted in the revolver 60 at the top of the handle 69 on the inside surface behind the trigger 62. In order to actuate the revolver, the trigger 62 must be withdrawn and the actuating rod 31 blocks the rebound slide pin 71 in the rebound slide spring 93 but, as previously explained, use of the glove 41 with the ferromagnetic disk 43 makes operation readily available.

Figure 8:
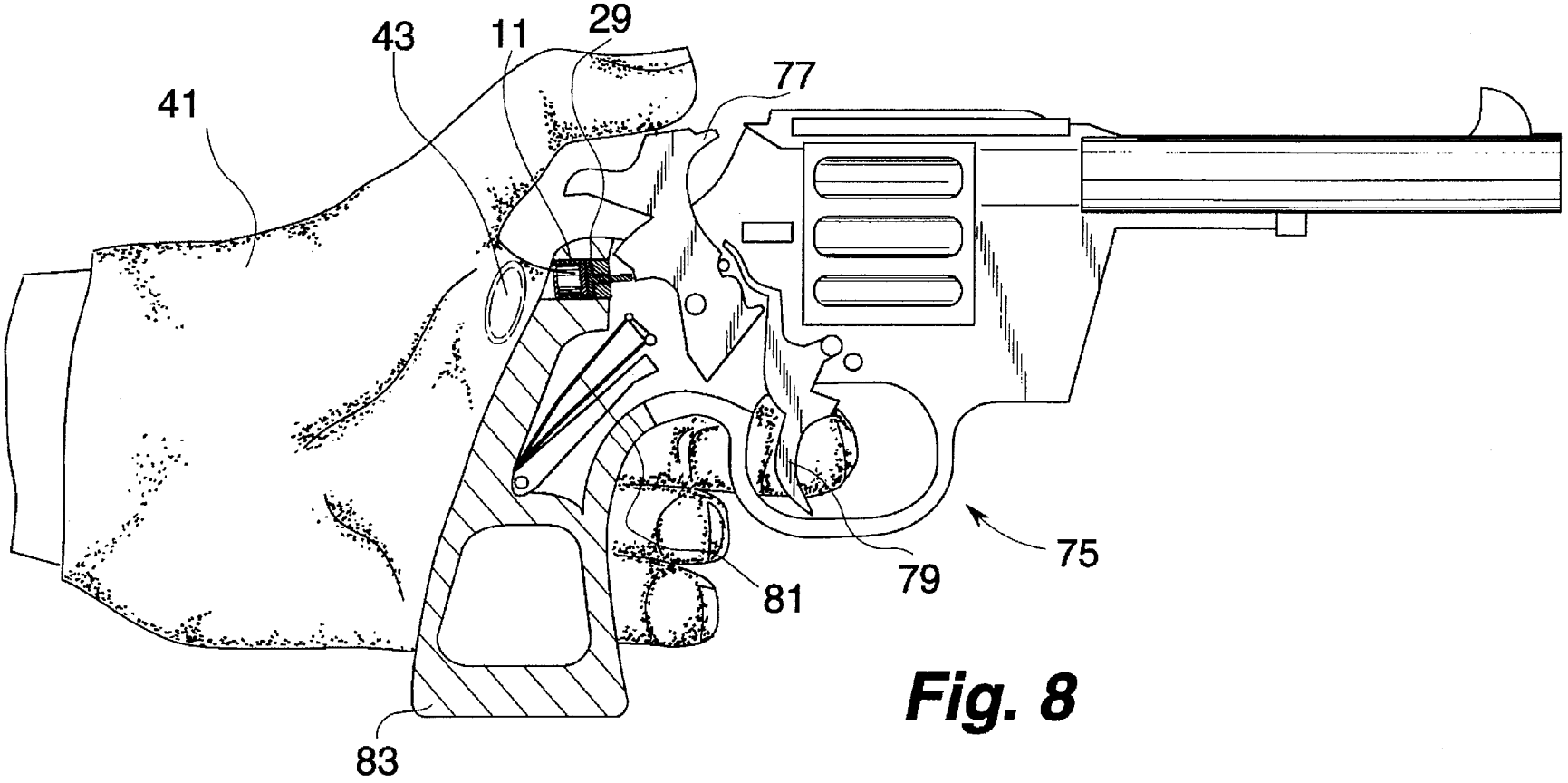
FIG. 8 is a side plan view of still another version of an existing revolver showing the safety device blocking a part of the firing mechanism of the revolver and showing the glove with the ferromagnetic disk on the glove and the glove the hand of the operator.

In FIG. 8, still another version of an existing revolver 75 is shown. As in the previously-described revolvers, a hammer 77 is shown and a trigger 79. The hammer 77 operates against the force of a leaf spring 81. The safety device, in this situation, is mounted at the upper rear of the handle 83 just behind the hammer 77. The actuating rod 31 prevents movement of the hammer 77 and thus firing of the weapon. The glove 41 and ferromagnetic disk 43 are shown and are used as previously described.

Figure 9:
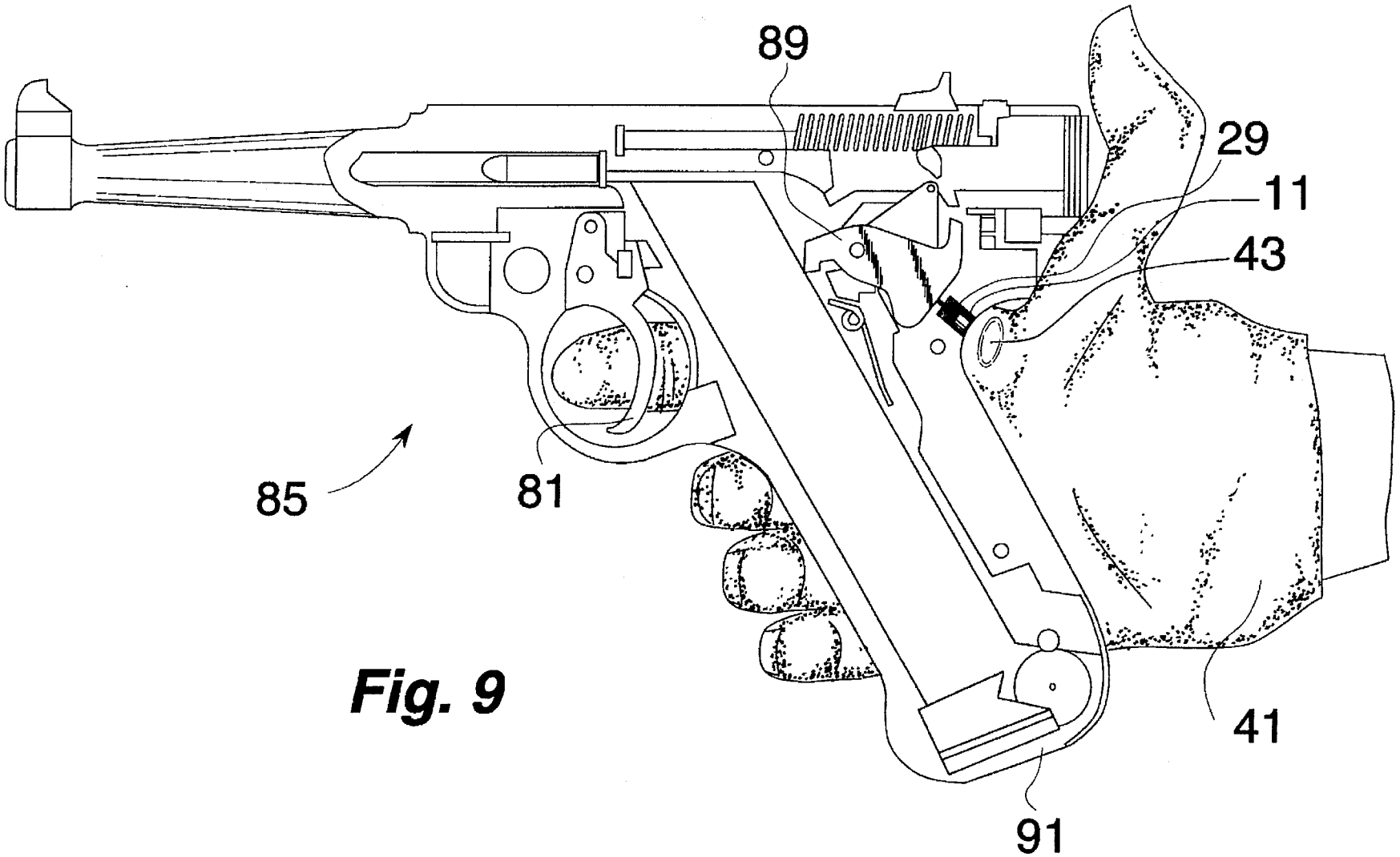
FIG. 9 is a side plan view of an automatic pistol partially is cross-section showing the safety device in a location to block the firing mechanism of the automatic and with the glove having the ferromagnetic disk in place on the glove and the glove on the hand of the operator.

In FIG. 9, a different type of handgun is shown, namely a well-known and existing version of an automatic pistol 85. Again a trigger 87 is used to fire the weapon and an internal hammer 89 is used. The safety device is inserted at the upper end of the handle at the rear of the handle 91 to prevent rotation of the internal hammer 89. Once again, the glove 41 with the ferromagnetic disk 43 is used to withdrawn the actuating rod 31 and permit operation of the weapon.

Regardless of the weapon, the safety device in accordance with this invention may also be used on rifles and shotguns and any other projectile firing weapon in which there is a movable part, whose movement is essential for firing, which part can be blocked.

As has been previously mentioned, when the glove 41 is removed from the weapon, it is important that the actuating rod 31 return quickly to the safe or locked position. In many weapons, the ferromagnetic material in the weapon will cause the magnet section 37 to draw back toward the inside end 17 of the cylindrical member 13 but this may not always be possible under some circumstances, so the ferromagnetic washer 35 is installed to attract the magnet section 37. The cushion washer 33 is made to provide a soft pad against which the piston 29 rests and also, within limits blocks the magnetic attraction between the magnet section 37 and the ferromagnetic washer 35. Therefore, use of the cushion washer 33 between the ferromagnetic washer 35 and the magnet section 37 makes the ferromagnetic disk 43 more attractive to the magnet section 37 than the ferromagnetic washer 35 and a careful balance must be achieved to assure that the magnet section 37 will move toward the ferromagnetic disk 43 on the glove 41 when the glove 41 is in place and not be withheld by the ferromagnetic material in the weapon itself or by the ferromagnetic washer 35.

Thus, while a preferred embodiment of the invention has been shown and described, it will be apparent to those skilled in the art that many other changes and modifications may be made without departing from the invention in its broader aspects. the appended claims are therefore intended to cover all such changes and modifications as fall within the true spirit and scope of the invention.

I claim:

1. A safety device for preventing the unauthorized actuation of equipment which has a part which must move to actuate the equipment, such safety device including:

a sleeve mounted in the equipment, the sleeve having as outside end and an inside end, a large chamber extending from the outside end a major portion of the distance to the inside end of the sleeve, a small opening extending from the large chamber to the inside end of the sleeve, the sleeve being made of a nonferromagnetic material;

a plunger including both a piston and an actuating rod, the piston being slidable within the large chamber and the actuating rod being slidable in the small opening and extending beyond the inside end of the sleeve, the piston having a magnet section located toward the outside end and a nonferromagnetic section located toward the inside end, the magnet section and the nonferromagnetic section being layered together, the actuating rod being made of nonferromagnetic material;

a cushioning washer located in the large chamber about the actuating rod toward the inside end;

a retainer cap secured to the sleeve at the outside end, the inside end of the sleeve being within the equipment; and a ferromagnetic disk outside the equipment for attracting the magnet section when actuation of the equipment is desired.

2. A safety device according to claim 1 wherein the ferromagnetic disk outside the equipment is secured to the outside of a glove.

3. A safety device according to claim 1 further including a ferromagnetic washer located adjacent the cushioning washer toward the inside end of the sleeve.

4. A safety device for preventing the unauthorized actuation of equipment which has a part which must move to actuate the equipment, such safety device including:

a sleeve mounted in the equipment, the sleeve including a cylindrical member of nonferromagnetic material having an outside end and an inside end with a longitudinal axis extending from the outside end to the inside end and further including a large cylindrical chamber located concentrically along the longitudinal axis from the outside end a major portion of the distance to the inside end of the cylindrical member, a small opening concentrically located along the longitudinal axis of the cylindrical member from the large cylindrical chamber to the inside end of the cylindrical member;

a plunger including both a piston and an actuating rod, the piston being slidable within the large cylindrical chamber and the actuating rod being slidable in the small cylindrical opening and extending beyond the inside end of the cylindrical member, the piston having two sections, a magnet section located toward the outside end and a nonferromagnetic section located toward the inside end, the magnet section and the nonferromagnetic section being layered together;

a cushioning washer located in the large cylindrical chamber about the actuating rod toward the inside end;

a retainer cap secured to the sleeve at the outside end of the cylindrical member, the inside end of the cylindrical member being within the equipment;

a ferromagnetic disk outside the equipment for attracting the magnet section of the piston when actuation of the equipment is desired.

5. A safety device according to claim 4 including a ferromagnetic washer located adjacent the cushioning washer toward the inside end of the sleeve.

6. A safety device for preventing the unauthorized actuation of equipment which has a part which must move to actuate the equipment, such safety device including:

a sleeve mounted in the equipment, the sleeve including a cylindrical member of nonferromagnetic material having an outside end and an inside end with a longitudinal axis extending from the outside end to the inside end and further including a large cylindrical chamber located concentrically along the longitudinal axis from the outside end a major portion of the distance to the inside end of the cylindrical member, a small opening concentrically located along the longitudinal axis of the cylindrical member from the large cylindrical chamber to the inside end of the cylindrical member, a retainer chamber being located at the outside end and extending for a short distance concentrically along the longitudinal axis, the large cylindrical chamber having a diameter and the retainer chamber having a diameter, the diameter of the retainer chamber being slightly greater than the diameter of the large cylindrical chamber;

a plunger including both a piston and an actuating rod, the piston being slidable within the large cylindrical chamber and the actuating rod being slidable in the small cylindrical opening and extending beyond the inside end of the cylindrical member, the piston having two sections, a magnet section located toward the outside end and a nonferromagnetic section located toward the inside end, the magnet section and the nonferromagnetic section being layered together, the actuating rod being made of nonferromagnetic material;

a ferromagnetic washer located in the large cylindrical chamber about the actuating rod toward the inside end for attracting the magnet toward the inside end of the cylindrical member;

a cushioning washer adjacent the ferromagnetic washer toward the outside end of the cylindrical member;

a retainer cap secured into the retainer chamber, the retainer cap being generally adjacent the surface of the equipment and the inside end of the cylindrical member within the equipment; and a ferromagnetic disk outside the equipment for attracting the magnet section when actuation of the equipment is desired.

* * * * *